US008511431B2

(12) United States Patent
Woolley et al.

(10) Patent No.: US 8,511,431 B2
(45) Date of Patent: Aug. 20, 2013

(54) RETROFIT HANDRAIL SYSTEM FOR TRUCK

(75) Inventors: Richard Woolley, Acheson (CA); Harold Gudmundsen, Acheson (CA)

(73) Assignee: North American Fleet Company Ltd., Alberta (CA)

( * ) Notice: Subject to any disclaimer, the term of this patent is extended or adjusted under 35 U.S.C. 154(b) by 12 days.

(21) Appl. No.: 13/067,359

(22) Filed: May 26, 2011

(65) Prior Publication Data

US 2012/0298447 A1 Nov. 29, 2012

(51) Int. Cl.
*E06C 5/32* (2006.01)

(52) U.S. Cl.
USPC ..... 182/127; 182/106

(58) Field of Classification Search
USPC ..... 182/127, 106; 280/304.3, 164.1, 280/163; 296/1.02; D15/28
See application file for complete search history.

(56) References Cited

U.S. PATENT DOCUMENTS 4,425,984 A * 1/1984 Lachance ..... 182/106
4,976,455 A * 12/1990 Brammer et al. ..... 280/762
5,813,494 A * 9/1998 Ulschmid et al. ..... 182/97
D562,352 S * 2/2008 Matsuzaki et al. ..... D15/28
2004/0178602 A1* 9/2004 King et al. ..... 280/163
2007/0204437 A1* 9/2007 Hartmann et al. ..... 16/444

OTHER PUBLICATIONS

Caterpillar, Access System Upgrade for Cat 785 & 789 Trucks, 2010, USA, www.cat.com.

* cited by examiner

*Primary Examiner* — Katherine Mitchell
*Assistant Examiner* — Kristine FLorio
(74) *Attorney, Agent, or Firm* — Jean C. Edwards, Esq.; Edwards Neils PLLC

(57) ABSTRACT

A retrofit handrail extension system or kit enables a large mining truck to be retrofitted in the field. The handrail extension system includes a first handrail extension member for connecting a first upper portion of a first ladder to a railing mounted to a catwalk around the cabin of the truck and a second handrail extension member for connecting a second upper portion of the first ladder to a forward-facing handrail mounted to an outer surface of the cabin of the truck. The system may include a third handrail extension member for connecting a first upper portion of a second ladder to a first platform railing mounted to a platform beside the cabin of the truck and a fourth handrail extension member for connecting a second upper portion of the second ladder to a second platform railing mounted to the platform beside the cabin of the truck.

6 Claims, 3 Drawing Sheets

RETROFIT HANDRAIL SYSTEM FOR TRUCK

CROSS-REFERENCE TO RELATED APPLICATIONS

This is the first application filed for the present invention.

TECHNICAL FIELD

The present invention relates generally to ladders and handrails and, in particular, to handrails for large mining trucks.

BACKGROUND

Large mining trucks, off-road haul trucks or dump trucks may have one or more ladders for accessing the cabin. A variety of such trucks are manufactured by companies such as Euclid-Hitachi, Komatsu, Liebherr, Caterpillar, Bucyrus, etc. The operator of these types of trucks usually climbs up the ladder and then manoeuvres onto a small catwalk or platform before entering the cabin. Accidents have occurred when the operator slips and falls from the ladder. One solution to this problem is to retrofit the truck with a ladder system. For example, the Access System Upgrade for the Cat® 785 and 789 trucks is a diagonal stairway retrofit kit for the Caterpillar® 785 and 789 series trucks. This retrofit kit includes a stairway with handrails, bumper extension, walkway and secondary egress ladder.

However, there remains a need in the industry for a handrail retrofit system that is simpler, lighter, quicker to install and more cost-effective than prior-art designs.

SUMMARY

The present invention, in general, provides a handrail extension retrofit kit or system for retrofitting a handrail of a large mining truck. The handrail extension system or kit can be mounted to existing handrails and ladders of the truck with minimal downtime for the truck. The extension members may be bolted, welded or otherwise connected in the field in a simple, quick and efficient manner.

In accordance with one main aspect of the present invention, the handrail retrofit system for retrofitting a handrail of a truck having one or more ladders for accessing a cabin of the truck includes a first handrail extension member for connecting a first upper portion of one handrail of a first ladder to a railing mounted to a catwalk around the cabin of the truck and a second handrail extension member for connecting a second upper portion of another handrail of the first ladder to a forward-facing handrail mounted to an outer surface of the cabin of the truck.

In one main implementation, the system includes a third handrail extension member for connecting a first upper portion of one handrail of a second ladder to a first platform railing mounted to a platform beside the cabin of the truck and a fourth handrail extension member for connecting a second upper portion of another handrail of the second ladder to a second platform railing mounted to the platform beside the cabin of the truck.

In accordance with another main aspect of the present invention, a method for retrofitting a handrail of a truck entails connecting a first handrail extension member to a first upper portion of one handrail of a first ladder and to a railing mounted to a catwalk around the cabin of the truck and connecting a second handrail extension member to a second upper portion of another handrail of the first ladder and to a forward-facing handrail mounted to an outer surface of the cabin of the truck.

In one main implementation, the method also includes connecting a third handrail extension member to a first upper portion of one handrail of a second ladder and to a first platform railing mounted to a platform beside the cabin of the truck and connecting a fourth handrail extension member to a second upper portion of another handrail of the second ladder and to a second platform railing mounted to the platform beside the cabin of the truck.

BRIEF DESCRIPTION OF THE DRAWINGS

Further features and advantages of the present technology will become apparent from the following detailed description, taken in combination with the appended drawings, in which.

The components and parts shown in the figures are not necessarily drawn to scale.

DETAILED DESCRIPTION

In general, and by way of overview, the present invention provides a system and method for retrofitting a truck by connecting a plurality of handrail extension members to the existing ladders and handrails of the truck.

Figure 1:
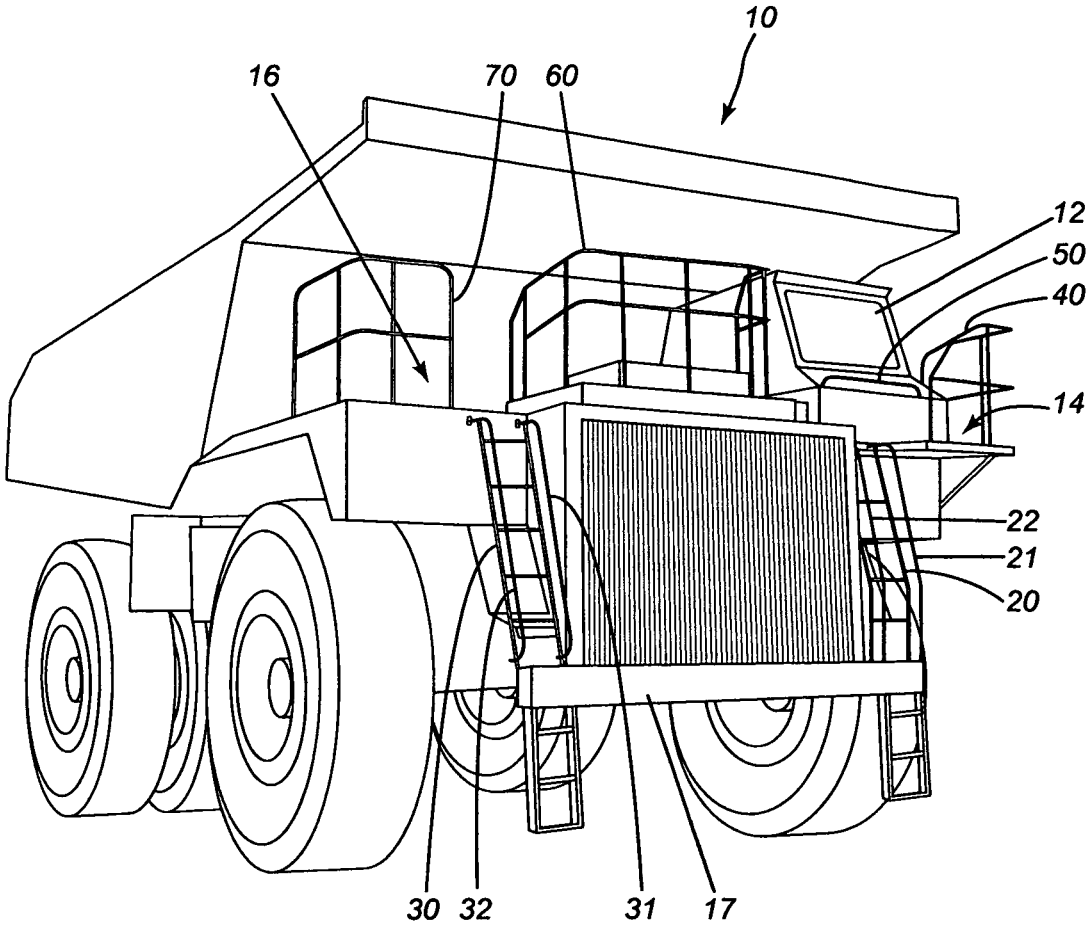
FIG. 1 is a perspective view of an example of a mining truck having two front-access ladders and respective handrails.

FIG. 1 is a perspective view of an example of a large mining truck, dump truck, off-road haul truck or equivalent, generally designated by reference numeral 10 on which a retrofit handrail system in accordance with embodiments of the present invention may be installed and used. As depicted by way of example in FIG. 1, the truck 10 has a cabin 12 for the driver and optionally one or more passengers. As further depicted by way of example in this figure, the truck 10 has two front-access ladders, namely a first ladder 20 and a second ladder 30. The first ladder has handrails 21, 22. The second ladder has handrails 31, 32. These ladders 20, 30 and their respective handrails 21, 22, 31, 32 are already assembled to the truck 10 at the time of manufacture and delivery.

The first ladder 20 provides access to a catwalk 14 around the cabin 12 of the truck 10. The second ladder 30 provides access to a platform 16 beside the cabin 12 of the truck 10. The cabin 12, in some trucks, may have a driver-side door and a passenger-side door, in which case the platform 16 may provide access to the passenger-side door. The first and second ladders 20, 30 may in such cases be referred to as the driver-side ladder and the passenger-side ladder (or as the left and right ladders).

In the particular example truck shown in FIG. 1, the handrails 21, 22 extend only partly down the length of the first ladder. Likewise, the handrails 31, 32 extend only partly down the length of the second ladder. As illustrated, in this example truck, the handrails 21, 22, 31, 32 extend down to the bumper 17 and further sections of ladder extend below the bumper.

In use, the operator (which is meant to refer to the driver, passenger, mechanic, or any person who climbs up one of the ladders) grips the bottom portion of the handrails 21, 22 when stepping up onto the bottom rung of the first ladder 20. Similarly, in use, the operator grips the bottom portion of the handrails 31, 32 when stepping up onto the bottom rung of the second ladder 30. When the operator reaches (or nears) the top of the first ladder 20, the operator must reach or stretch precariously for the railing 40 mounted to the catwalk 14 and/or reach for the forward-facing handrail 50 mounted to an outer surface of the cabin 12 (i.e. mounted a forward face of the truck). Similarly, when the operator reaches (or nears) the top of the second ladder 30, the operator must reach or stretch precariously for the first platform railing 60 and/or for the second platform railing 70. If the truck is wet or icy, the operator may be susceptible to slipping. A slip can occur not only when climbing up the first or second ladder but also when descending the first or second ladder.

Embodiments of the present invention provide a solution to this problem by providing a novel handrail retrofit system for retrofitting handrails or railings of a truck having one or more ladders for accessing the cabin.

Figure 2:
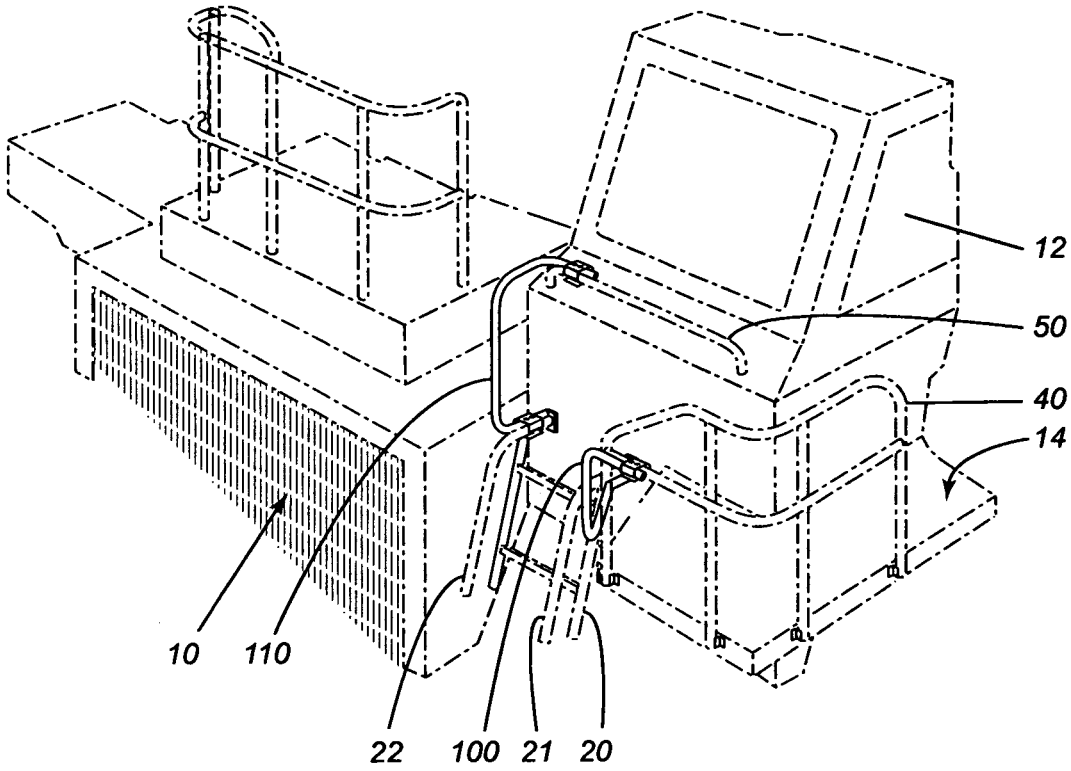
FIG. 2 is a perspective view of a retrofit handrail kit in accordance with an embodiment of the present invention, shown installed as a retrofit to the handrails of a first ladder of the truck of FIG. 1.

FIG. 2 is a perspective view of a retrofit handrail kit or system in accordance with an embodiment of the present invention, shown installed as a retrofit to the handrails of the first ladder 20 of the truck 10 of FIG. 1. In this illustrated embodiment, the handrail retrofit system includes a first handrail extension member 100 for connecting a first upper portion of the handrail 21 of the first ladder 20 to the railing 40 mounted to the catwalk 14 around the cabin 12 of the truck 10. A second handrail extension member 110 connects a second upper portion of the handrail 21 of the first ladder 20 to the forward-facing handrail 50 mounted to an outer surface of the cabin 12 of the truck 10.

Figure 3:
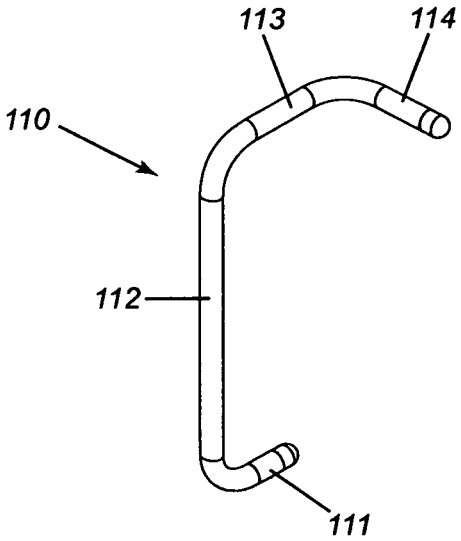
FIG. 3 is a perspective view of a first type of retrofit handrail member for use with the system of FIG. 2.

FIG. 3 is a perspective view of one type of retrofit handrail member 110 for use with the system of FIG. 2. As depicted by way of example in FIG. 3, the handrail extension member 110 comprises four angled sections 111, 112, 113, 114 forming a bent tubular structure. In this example embodiment, the four angled sections comprise a first section 111 extending orthogonally outwardly from a flat forward surface of the truck, a second section 112 extending vertically upwardly, a third section 113 extending rearwardly and parallel to the first section and a fourth section 114 parallel to the flat forward face of the truck.

Figure 4:
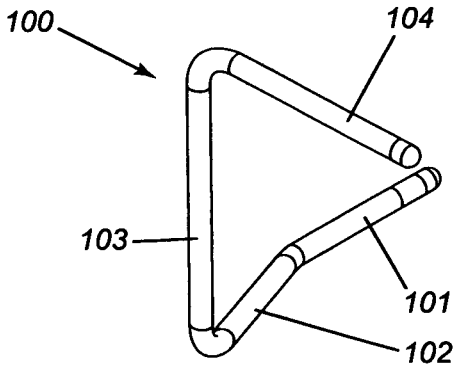
FIG. 4 is a perspective view of a second type of retrofit handrail member for use with the system of FIG. 2.

FIG. 4 is a perspective view of another type of retrofit handrail member 100 for use with the system of FIG. 2. As depicted by way of example in FIG. 4, the handrail extension member 100 comprises four angled sections 101, 102, 103, 104 forming a bent tubular structure. In this example embodiment, the four angled sections comprise a first section 101 extending orthogonally outwardly from a flat forward surface of the truck, a second section 102 extending at angle downwardly and outwardly from the first section, a third section 103 extending vertically upwardly, and a fourth section 104 parallel to the flat forward face of the truck.

As will be appreciated by those of skill in the art, the first and second extension members 100, 110 may have other shapes or configurations. In one embodiment, these members are made of tubular steel or tubular aluminum.

Figure 5:
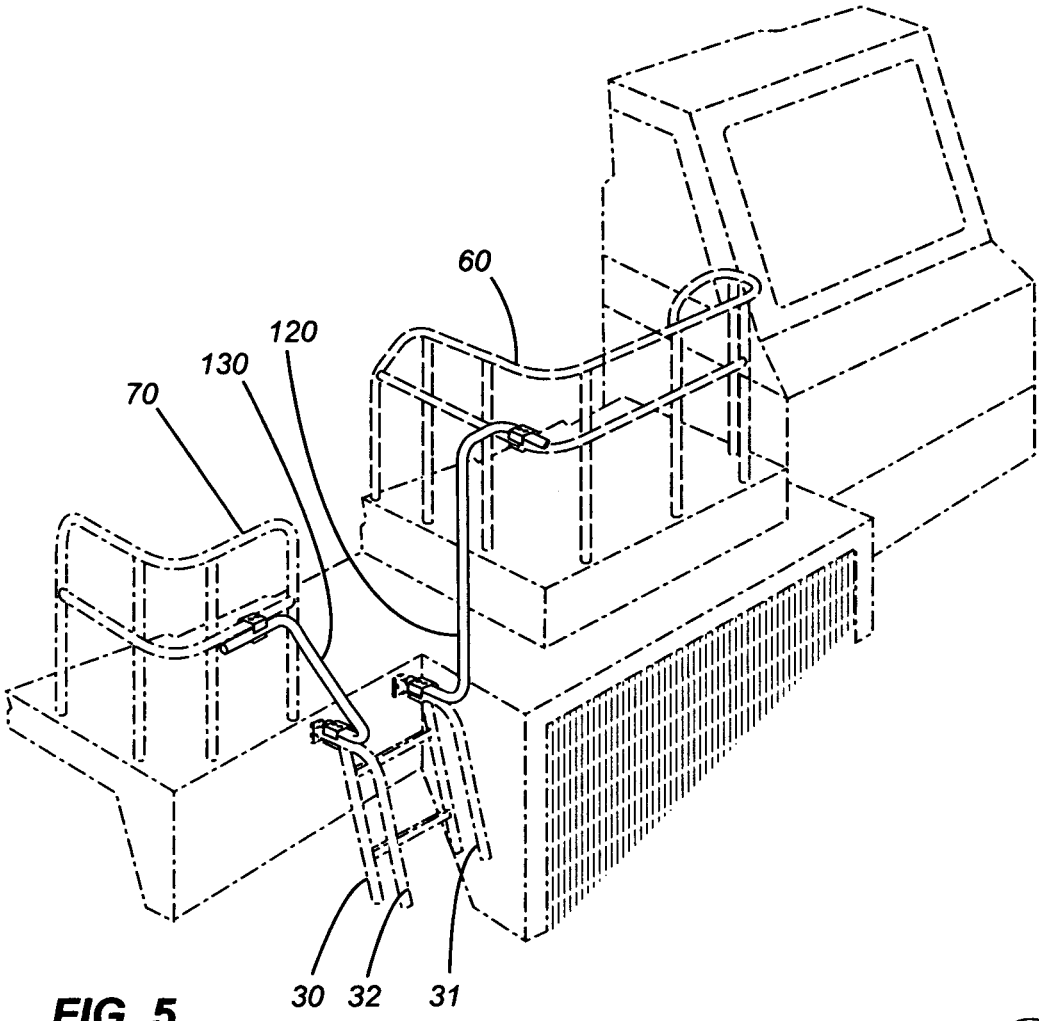
FIG. 5 is a perspective view of a retrofit handrail system in accordance with an embodiment of the present invention, shown installed as a retrofit to the handrails of the second ladder of the truck of FIG. 1.

In addition to retrofitting the handrails of the first ladder, the handrails 31, 32 of the second ladder 30 may also be retrofitted as shown by way of example in FIG. 5.

FIG. 5 is a perspective view of a retrofit handrail system in accordance with an embodiment of the present invention, shown installed as a retrofit to the handrails 31, 32 of the second ladder 30 of the truck 10 of FIG. 1.

In the embodiment illustrated in FIG. 5, the retrofit handrail system includes a third handrail extension member 120 for connecting a first upper portion of the handrail 31 of the second ladder 30 to the first platform railing 60 mounted to the platform 16 beside the cabin 12 of the truck 10. The system also includes a fourth handrail extension member 130 for connecting a second upper portion of the handrail 32 of the second ladder 30 to the second platform railing 70 mounted to the platform 16 beside the cabin 12 of the truck 10. The platform 16 may actually have more than one platform surface, as illustrated in this example where the platform surface adjacent the cabin is raised by a step relative to the remainder of platform.

Figure 6:
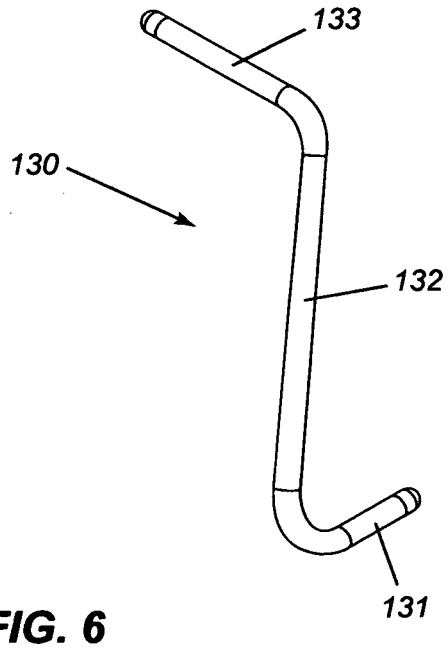
FIG. 6 is a perspective view of a third type of retrofit handrail member for use with the system of FIG. 5.

FIG. 6 is a perspective view of one type of retrofit handrail member 130 for use with the system of FIG. 5. As depicted by way of example in FIG. 6, the retrofit handrail member 130 includes three angled sections 131, 132, 133 forming a bent tubular structure. In this example embodiment, the three angled sections comprise a first section 131 extending orthogonally outwardly from a flat forward surface of the truck, a second section 132 angled at an angle between 30 and 60 degrees to the first section, and a third section 133 extending parallel to the flat forward surface of the truck.

Figure 7:
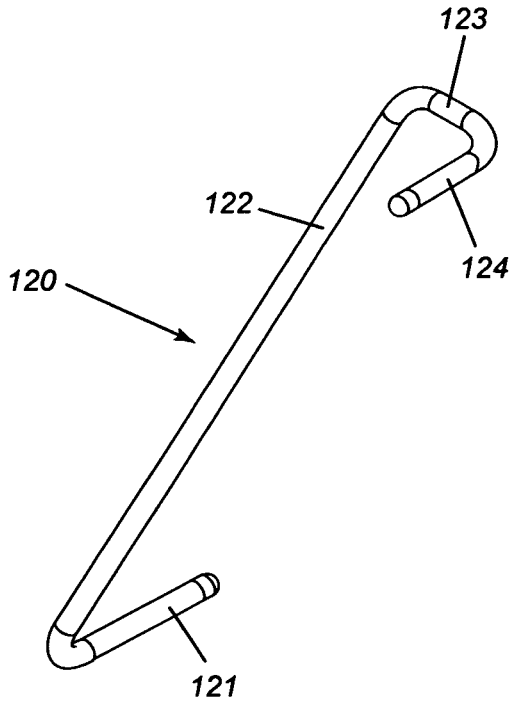
FIG. 7 is a perspective view of a fourth type of retrofit handrail member for use with the system of FIG. 5.

FIG. 7 is a perspective view of another type of retrofit handrail member 120 for use with the system of FIG. 5. As depicted by way of example in FIG. 7, the retrofit handrail member 120 includes four angled sections 121, 122, 123, 124 forming a bent tubular structure. In this example embodiment, the four angled sections comprise a first section 121 extending orthogonally outwardly from a flat forward surface of the truck, a second section 122 extending vertically upwardly, a third section 123 extending perpendicular to both the first and second sections, and a fourth section 124 parallel to the first section.

As will be appreciated by those of skill in the art, the third and fourth extension members 120, 130 may have other shapes or configurations. In one embodiment, these members are made of tubular steel or tubular aluminum.

Figure 8:
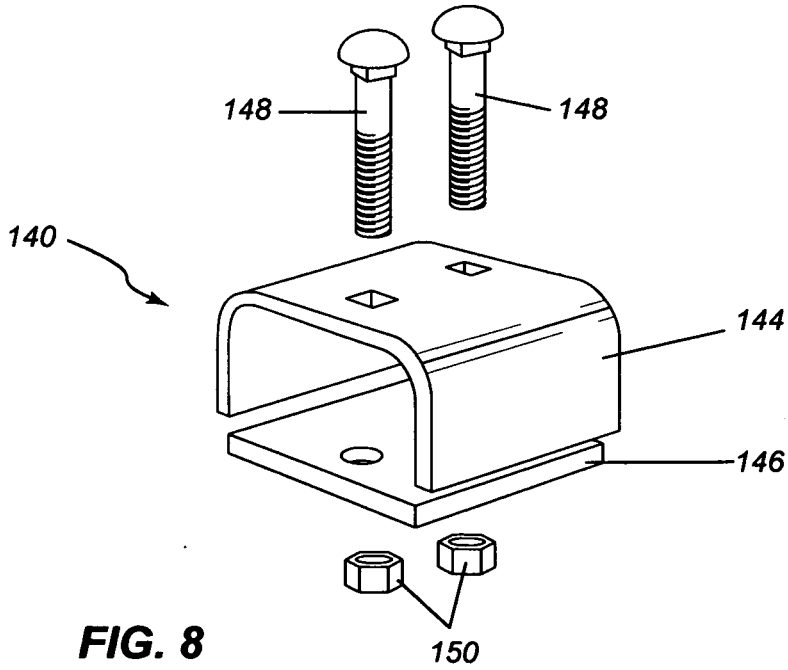
FIG. 8 is a perspective view of a bracket and fastener clamping system for use in bolt-on embodiments of the present invention.

FIG. 8 is a perspective view of a bracket-and-fastener clamping system for use in bolt-on embodiments of the present invention. The bracket clamping system 140 illustrated by way of example in this figure includes a U-shaped bracket 144, a plate 146, two bolts 148 and two nuts 150. Other clamping or bolt-on mechanisms may be employed. Furthermore, in other embodiments, the handrail extension members may be connected by welding or by any other known mechanical means.

The retrofit kit or retrofit system disclosed herein may include extension members for just one ladder (i.e. just members 100, 110 or just members 120, 130) or for both ladders. Optionally, the members may include a roughened surface finish, rubberized or anti-slip covers, paint with grit, etc. to improve the operator's grip, particularly for wet or icy conditions.

The retrofit kit disclosed herein provides continuous 3-point contact for the operator of the truck when climbing up or down the ladders. This kit when installed thus minimizes the risk of falling from the ladders.

The retrofit kit provides a number of significant advantages over the prior art. The retrofit kit is not only simpler and less expensive to manufacture but also easier and less expensive to deliver and install than the full ladder upgrade systems. Because it is so easy to install, there is far less truck downtime with the retrofit kit than with a full ladder upgrade system. Furthermore, depending on the accessibility of the truck frame, the full ladder upgrade system may need to be mounted to the bumper and radiator cover which is not as secure as mounting to the frame. The retrofit kit mounts directly to the railings, thus avoiding the problem of imposing stresses on the bumper or radiator cover. For these various reasons, the novel retrofit kit provides a simple, easy and cost-effective means to retrofit a truck ladder-and-railing system.

The embodiments of the invention described above are intended to be exemplary only. As will be appreciated by those of ordinary skill in the art, to whom this specification is addressed, many obvious variations can be made to the embodiments present herein without departing from the spirit and scope of the invention. The scope of the exclusive right sought by the applicant is therefore intended to be limited solely by the appended claims.

The invention claimed is:

1. A handrail retrofit system for retrofitting a handrail of a truck having two or more ladders for accessing a cabin or catwalk, the handrail retrofit system comprising:

a first handrail extension member for connecting a first upper portion of one handrail of a first ladder extending vertically along a front face of the truck to a railing mounted to the catwalk around the cabin of the truck, wherein the first handrail extension member comprises four angled sections forming a bent tubular structure, wherein the four angled sections comprise a first section extending orthogonally outwardly from a flat forward surface of the truck, a second section extending at an angle downwardly and outwardly from the first section, a third section extending vertically upwardly, and a fourth section parallel to the flat forward surface of the truck; and a second handrail extension member connecting a second upper portion of another handrail of the first ladder to a forward-facing handrail mounted to an outer surface of the cabin of the truck, wherein the second handrail extension member comprises four angled sections forming a bent tubular structure, wherein the four angled sections comprise a first section extending orthogonally outwardly from the flat forward surface of the truck, a second section extending vertically upwardly, a third section extending rearwardly and parallel to the first section, and a fourth section parallel to the flat forward face surface of the truck.

2. The system as claimed in claim 1 further comprising:

a third handrail extension member connecting a first upper portion of one handrail of a second ladder extending vertically along the front face of the truck to a first platform railing mounted to a platform beside the cabin of the truck, wherein the third handrail extension member comprises four angled sections forming a bent tubular structure, wherein the four angled sections comprise a first section extending orthogonally outwardly from the flat forward surface of the truck, a second section extending vertically upwardly, a third section extending perpendicular to both the first and second sections, and a fourth section parallel to the first section; and a fourth handrail extension member for connecting a second upper portion of another handrail of the second ladder to a second platform railing mounted to the platform beside the cabin of the truck, wherein the fourth handrail extension member comprises three angled sections forming a bent tubular structure, wherein the three angled sections comprise a first section extending orthogonally outwardly from the flat forward surface of the truck, a second section angled at an angle between 30 and 60 degrees to the first section, and a third section extending parallel to the flat forward surface of the truck.

3. A method of retrofitting a handrail on a truck, the method comprising:

connecting a first handrail extension member to a first upper portion of one handrail of a first ladder extending vertically along a front face of the truck and to a railing mounted to a catwalk around the cabin of the truck; and connecting a second handrail extension member to a second upper portion of another handrail of the first ladder and to a forward-facing handrail mounted to an outer surface of the cabin of the truck, wherein connecting the first handrail extension member comprises clamping the first handrail extension member to the handrail of the first ladder and to the railing using brackets and fasteners, and wherein connecting the second handrail extension member comprises clamping the second handrail extension member to the other handrail of the first ladder and to the forward-facing handrail using other brackets and fasteners.

4. The method as claimed in claim 3 wherein comprises:

connecting a third handrail extension member to a first upper portion of one handrail of a second ladder extending vertically along the face front of the truck and to a first platform railing mounted to a platform beside the cabin of the truck; and connecting a fourth handrail extension member to a second upper portion of another handrail of the second ladder and to a second platform railing mounted to the platform beside the cabin of the truck, wherein connecting the third handrail extension member comprises clamping the third handrail extension member to the handrail of the second ladder and to the first platform railing using brackets and fasteners, and wherein connecting the fourth handrail extension member comprises clamping the fourth handrail extension member to the other handrail of the second ladder and to the second platform railing using other brackets and fasteners.

5. A truck having two or more ladders extending vertically along a front face of the truck for accessing a cabin or catwalk, the truck comprising a handrail retrofit system that includes:

a first handrail extension member connecting a first upper portion of one handrail of a first ladder extending vertically along the front face of the truck to a railing mounted to the catwalk around the cabin of the truck, wherein the first handrail extension member comprises four angled sections forming a bent tubular structure, wherein the four angled sections comprise a first section extending orthogonally outwardly from a flat forward surface of the truck, a second section extending at angle downwardly and outwardly from the first section, a third section extending vertically upwardly, and a fourth section parallel to the flat forward surface of the truck; and a second handrail extension member connecting a second upper portion of another handrail of the first ladder to a forward-facing handrail mounted to an outer surface of the cabin of the truck, wherein the second handrail extension member comprises four angled sections forming a bent tubular structure, wherein the four angled sections comprise a first section extending orthogonally outwardly from the flat forward surface of the truck, a second section extending vertically upwardly, a third section extending rearwardly and parallel to the first section and a fourth section parallel to the flat forward surface of the truck.

6. The truck as claimed in claim 5 further comprising:

a third handrail extension member connecting a first upper portion of one handrail of a second ladder extending vertically along the front face of the truck to a first platform railing mounted to a platform beside the cabin of the truck, wherein the third handrail extension member comprises four angled sections forming a bent tubular structure, wherein the four angled sections comprise a first section extending orthogonally outwardly from the flat forward surface of the truck, a second section extending vertically upwardly, a third section extending perpendicular to both the first and second sections, and a fourth section parallel to the first section; and a fourth handrail extension member connecting a second upper portion of another handrail of the second ladder to a second platform railing mounted to the platform beside the cabin of the truck, wherein the fourth handrail extension member comprises three angled sections forming a bent tubular structure, wherein the three angled sections comprise a first section extending orthogonally outwardly from the flat forward surface of the truck, a second section angled at an angle between 30 and 60 degrees to the first section, and a third section extending parallel to the flat forward surface of the truck.

* * * * *